United States Patent [19]

Fadeev et al.

[11] 4,343,368

[45] Aug. 10, 1982

[54] IDLE STROKE BRAKING UNIT FOR AN IMPACT DEVICE

[76] Inventors: Vladimir Y. Fadeev, ulitsa Tereshkovoi, 6, kv. 180; Petr Y. Fadeeve, ulitsa Russkaya, 25, kv. 204; Vladlen V. Korobkov, ulitsa Shljuzovaya, 12, kv. 17; Rim A. Kulagin, ulitsa Tereshkovoi, 2, kv. 22; Nikolai P. Ermilov, ulitsa Rossiiskaya, 12, kv. 56, all of Novosibirsk, U.S.S.R.

[21] Appl. No.: 105,859

[22] Filed: Dec. 20, 1979

[51] Int. Cl.[3] ..... B25D 9/04

[52] U.S. Cl. ..... 173/139; 92/12

[58] Field of Search ..... 173/119, 139; 92/12, 92/8

[56] References Cited

U.S. PATENT DOCUMENTS 3,605,916 11/1969 Voitsekhousky .

3,892,279 7/1975 Amtsberg ..... 173/139 X

FOREIGN PATENT DOCUMENTS 46-20995 12/1966 Japan ..... 173/139

575414 11/1977 U.S.S.R. ..... 173/139

599068 3/1978 U.S.S.R. ..... 173/139

*Primary Examiner*—Werner H. Schroeder

*Assistant Examiner*—Andrew M. Falik

*Attorney, Agent, or Firm*—Fleit & Jacobson

[57] ABSTRACT

An impact device for producing impact pulses comprising a body with a movable ram having a front part transmitting the impact pulses and an extension housed in a power cylinder which is connected with the body and filled with a fluid medium under pressure for acting on the end face of the ram extension. There is also a unit ensuring the reverse stroke of the ram mounted on the body and interacting with the ram, and a unit for braking the ram on its idle stroke. According to the invention, the braking unit is formed by a space in the body which opens on one side into the power cylinder and by a movable cylindrical member accommodated in such space. The cylindrical member has bosses separated by a space from each other. The end of the cylindrical member protrudes from the body into the power cylinder while the bosses are located inside the space so that they form a chamber filled with a medium for the reverse stroke of the cylindrical member, and a chamber filled with fluid. The ram extension is provided with a boss interacting with the cylindrical member. The space has a throttling projection inside, located between the bosses and forming, together with the surface of the cylindrical member, a gap for throttling the fluid during braking of the ram on the idle stroke of the latter.

14 Claims, 11 Drawing Figures

IDLE STROKE BRAKING UNIT FOR AN IMPACT DEVICE

The present invention relates to power pulse systems designed to produce power pulses of a certain frequency and intensity for acting on the object of work and more particularly it relates to impact devices for producing powerful impact pulses.

The present invention will provide most useful in mining industry, for example in machines for blastless driving of workings in hard highly-abrasive rocks and in machines built for breaking up oversize lumps of rock.

The invention can also be utilized in construction, for example in machines or driving piles, demolishing old foundations and walls, opening up concrete road pavements, etc.

Besides, the present invention can be employed in machinebuilding, in high-speed forging and swage hammers, cutting machines, etc.

Known in the prior art is an impact device (e.g. U.S. Pat. No. 4,089,380, May 16, 1978) wherein the impact pulse is transmitted from a piston-ram to the object of work through a fluid-filled chamber and an intermediate body, i.e. working tool.

This device consists of a body accommodating a working cylinder closed by two covers, viz., front and rear ones, the rear cover being of blind construction while the front one has a space opening into the cylinder and a hole for the passage of the tool extension into said space, the front specially sharpened part of the tool resting on the object of work. The tool has a projection in the middle, contacting the front face of the body to ensure preliminary pressure of the sharpened tool point on the object of work.

Reciprocating inside the working cylinder is a piston-ram whose front end is smaller in diameter than the cylinders bore and equal to the diameter of the space in the front cover.

The piston-ram separates the internal space of the working cylinder into two chambers, viz., a rear gas chamber filled with compressed gas and connected for increasing the working volume of the compressed gas and with a receiver rigidly secured on the body, and a front cocking space which is filled with service fluid on the cocking stroke of the piston-ram.

The front part of the working cylinder is provided with large ports closed with a special valve, and a hole for feeding in service fluid under a high pressure.

At the point of location of the working cylinder ports the body of the device has a special space of a considerable volume, said space receiving the service fluid thrown out during the working stroke of the piston-ram. This space is connected with a fluid reservoir via a pump means which ensures slow evacuation of fluid from said space.

As the fluid under pressure is delivered into the cocking space, the piston-ram performs a cocking stroke, compressing gas in the gas space of the working cylinder and thus accumulating energy for the subsequent power stroke. As the piston-ram reaches the rearmost position and the gas in the gas chamber of the working cylinder is compressed to a maximum, the valve opens, the piston-ram actuated by the compressed gas is accelerated and performs a power stroke, pushing the fluid through large ports from the cocking space of the working cylinder into a special space of the body. At the end of the power stroke the front end of the piston-ram enters the space of the front cover at a high speed, locks the fluid remaining there and compresses it. The compressed fluid acts on the tool extension, forcing the tool to move forward to the object of work and to act on it with its sharpened point. After the piston-ram has completely stopped at the end of the power stroke the valve closes the large ports on the front part of the working cylinder, thus providing the conditions for the next working cycle.

The device described above has no braking unit for braking the piston-ram at the end of the power stroke. The absence of the braking unit causes considerable impact loads on the elements of the device in case of a low rigidity of the object of work and, as a result, incomplete application of energy of the impact pulse to the object of work.

These impact loads on the elements of the devide may be substantially greater than the normal working loads and, consequently, reduce the service life and reliability of the device.

Another impact device known in the prior art (see, for example, U.S. Pat. No. 3,605,916 of Sept. 20, 1971) comprises a body, a working cylinder secured in the body and having a blind rear cover and a front cover with an opening, a ram installed with a provision for reciprocating in damped guides secured on the body, the extension of said ram being connected by a rod passing through the opening in the front cover of the working cylinder with the piston group housed inside the working cylinder.

The piston group consists of a piston-sleeve whose outer cylindrical surface slides over the internal surface of the working cylinder, and of a piston connected with said rod and accommodated in the space of the piston-sleeve.

The piston group divides the inner space of the working cylinder into two chambers; a rear gas chamber filled with gas and connected with a tubular receiver of the body for increasing the volume of the compressed gas, and a front chamber which receives the service fluid during the cocking stroke of the ram.

The front part of the working cylinder has large ports closed by the valve during the cocking stroke of the ram, and a hole for providing in the service fluid under high pressure.

The delivery of the fluid under pressure into the front chamber forces the piston group backward, to the gas chamber of the working cylinder. On its way, the piston group compresses additionally the gas in the gas chamber and in the receiver and cocks the ram by the rod, moving in said ram in the direction indicated above.

As soon as the movable system comprising of the ram, rod and piston group comes to the rearmost position, the ports on the front part of the working cylinder are opened by the valve, the piston group is accelerated forward, pushes the fluid outside through said ports and accelerates the ram by the rod. This movement continues until the front part of the ram comes on contact with the object of work after which the movable system stops and transmits the accumulated energy to the object of work in the form of an impact pulse.

If, however, the ram encounters no resistance of the object of work at the end of the power stroke, the piston-sleeve will reach the front cover of the working cylinder and thrust against it with the front end while the piston connected by the rod with the ram continues moving forward and forces the fluid into said large ports through the gaps between the edge of the piston-sleeve and the cylindrical surface of the working cylinder. This increases the fluid pressure in the piston-sleeve and brakes the piston and the ram connected with said piston by the rod.

On completion of the power stroke of the ram the valve closes the large ports on the working cylinder thereby preparing the device for the next working cycle.

This piston group taking part in the impact is subjected to considerable overloads. During the working impact, when the ram at the end of its power stroke interacts with the object of work, there occurs a strong vibratory collision of the inner surface of the piston-sleeve with the rear end surface of the piston which ruins rapidly the entire piston group and, as a result, reduces the life and reliability of the entire device.

An object of the present invention resides in increasing the reliability and service life of the impact device.

The main object of the invention resides in providing an impact device wherein the braking unit would be constructed so as to reduce the impact loads on the elements of the device during the idle stroke of the ram.

The substance of the invention lies in providing an impact device for generating impact pulses acting on the object of work. The impact device includes a body accommodating a reciprocating ram which has a front part transmitting the impact pulses to the object of work and an extension accommodated in the power cylinder connected to accumulate potential energy in the power cylinder when said fluid is compressed during the cocking stroke of the ram and to act on the end of the ram extension during its forward stroke. A ram reverse stroke unit is mounted on the body and interacts with the ram for performing the reverse stroke thereof. A unit for braking the ram on its idle was is also mounted on the body. The braking unit consists of at least one space in the body which opens at one side into the power cylinder and accommodates at least one cylindrical member installed with a provision for reciprocating therein. One end of said cylindrical member is provided with a circular piston-like boss, the middle part having another circular boss separated by a space from said piston-like boss. The other end of the cylindrical member protrudes from the body into the power cylinder while the piston-like and other bosses are located inside the body, contacting its surface so that the face surface of the piston-like boss and the surface of the body space at one end of the cylindrical member form a chamber filled with a fluid under pressure for ensuring the reverse stroke of the cylindrical member while the surface of the cylindrical member between the piston-like and other bosses and the surface of the body space form a fluid-filled brake chamber. The ram extension is provided near its end with at least one boss 17 intended to interact with the other end of the cylindrical member and the inside space of the body has a throttling projection located between the piston-like and other bosses and, together with the surface of the cylindrical member, forms a gap intended for throttling the fluid in the course of braking of said ram during its idle stroke.

This construction of the ram braking unit rules out completely the possibility of origination of loads in the elements of said unit on the working stroke of the ram and permits reducing to permissible limits the loads on said elements originated when the ram is braked on its idle stroke.

It is practicable that the peripheral surface of the cylindrical member between the piston-like and other bosses should be made in such a manner that the fluid would be throttled with a constant pressure differential.

This construction of said surface ensures a constant braking force on the ram during its idle stroke on the entire braking path and, consequently, minimum loads on the elements of the braking unit on a preset breaking path.

It is preferable that the other end of the cylindrical member should be provided with a cup-shaped element arranged coaxially with the ram and having an opening in the bottom for the passage of said ram, and that the diameter of the space of the cup-shaped element should be substantially equal to the diameter of the boss on the ram extension.

The use of the cup-shaped element permits a substantial reduction of the contact stresses on the face of the other end of the cylindrical member and on the face of the boss on the ram extension at the moment of their interaction, particularly in the beginning of braking the ram on its idle stroke.

It is expedient that the peripheral surface of the cylindrical member between its piston-like and other bosses should be provided with a recess adjoining the piston-like boss, the width of said recess being not less than that of the throttling projection of the body so that when the throttling projection faces the recess, the passage area through the gap between the recess and the projection would reduce the resistance to throttling of fluid at the initial moment of movement of the cylindrical member.

The provision of said recess reduces the time for equalizing the speeds of the ram and cylindrical member during their interaction at the beginning of ram braking and reduces the total braking path of the ram and the depth of the space of said cup-shaped element which leads eventually to a substantial reduction of the total size of the device at a preset working stroke of the ram.

In some cases it is preferable that the braking unit should be formed by a single space made in the body coaxially therewith, and that the face wall of said space should have an opening for the passage of the ram, and by one cylindrical member in the form of a sleeve fitted around the ram with a provision for moving relative thereto.

The above-described design of the braking unit in some cases diminishes substantially the lateral dimensions of the entire device, simplifies its manufacture and reduces operating expenses.

In some instances it is desirable that the braking unit should be constituted by several spaces equispaced in the body around the circumference and parallel to the ram axis, and by a corresponding number of cylindrical members accommodated in said spaces.

Such a construction of the braking unit reduces the total mass of the unit elements, simplifies its servicing and repairs.

It is highly desirable that the reverse stroke chamber of the cylindrical member should be put in constant communication with the power cylinder.

Constant communication of the reverse stroke chamber with the power cylinder makes it possible to decrease the number of inlets to the device and to reduce substantially the volume of the chamber proper which eventually simplifies the design of the device and reduces its mass and overall dimensions.

In the case of a braking unit constituted by a single body member coaxial with the ram and by a cylindrical member in the form of a sleeve it is desirable that the reverse stroke chamber should communicate with the power cylinder through a passage in the body.

Such a location of the passage will reduce the mass of the sleeve simultaneously improving its strength characteristics.

In the case of the braking unit constituted by several spaces and cylindrical members accommodated therein it is convenient to put the reverse stroke chambers of the cylindrical member in communication with the power cylinder through a passage made in the cylindrical member.

Such a location of the passage simplifies substantially the design of the device with such a braking unit.

If a cup-shaped element is provided, it is expedient to provide a means for throttling the fluid medium by interaction of the projection on the ram extension with the cup-shaped element.

The provision of the throttling means makes it possible to maintain a constant pressure of the fluid medium at the initial moment of interaction between the ram extension and the cup-shaped element and to ensure their direct contact at the final stage of braking on the idle stroke of the ram.

Now the invention will be described in detail by way of example with reference to the accompanying drawings (in which.

Figure 1:
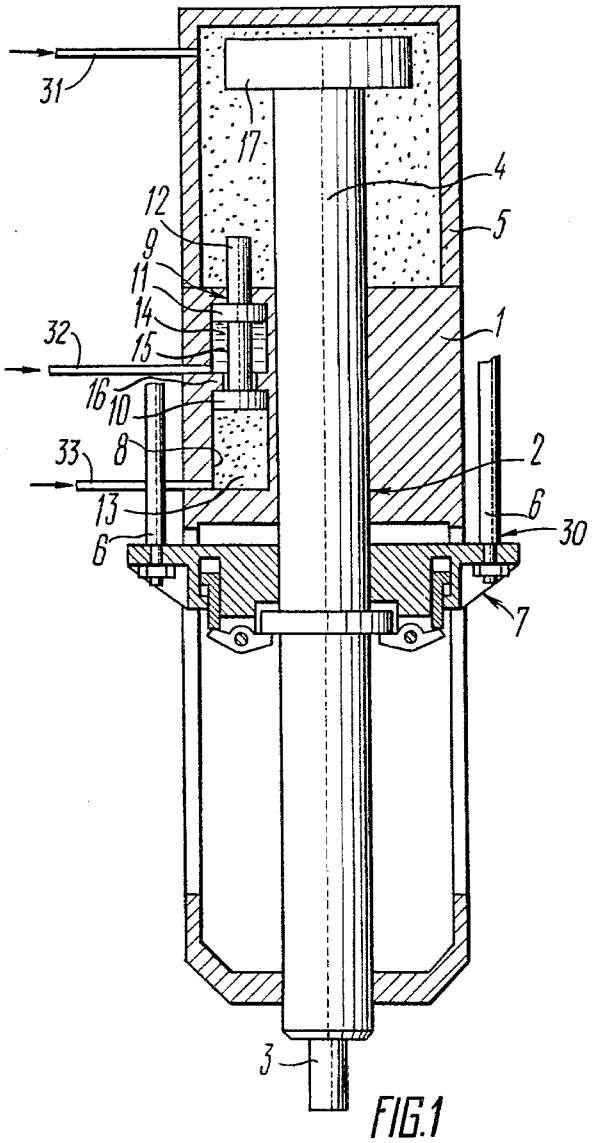
FIG. 1 is a schematic diagram of the impact device according to the invention.
Figure 6:
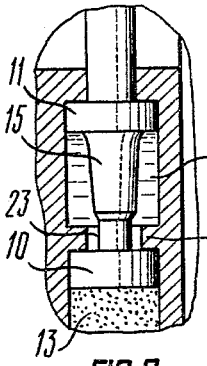
FIG. 6 shows the cylindrical member with a profiled surface and a recess, according to FIG. 1, enlarged.

A schematic drawing of the impact device according to the invention is shown in FIG. 1. The device comprises a body 1 installed in which reciprocatingly is a ram 2 having a front portion 3 intended to transmit impact pulses to the object of work, and an extension 4. The extension 4 is located in a power cylinder 5 connected with the body 1. The power cylinder 5 is filled through inlet tubing or pipe 31 with a fluid medium under a pressure ranging, as a rule, from fractions of MPa to several MPa. The abbreviation MPa stands for megapascal which is a pressure unit equal to million of pascals. One pascal corresponds to a force of one newton applied to an area of one square meter. Ths unit corresponds to the SI international system of units. The pressure of the fluid medium filling the power cylinder 5 depends both on the structural characteristics of the machine and on the energy of a single pulse required for the selected technological process. The fluid medium filling the power cylinder 5 is intended to accumulate energy when the fluid is additionally compressed by the reverse stroke of the ram 2 and to transmit the accumulated energy to the ram 2 by acting on the end of its extension 4 on its forward stroke. The fluid medium contained in the power cylinder is not expended so that it must be replenished only to make up for its losses through sealing elements.

Besides, the device is provided with a ram reverse stroke unit, generally designated 30, consisting of a drive (not shown in the drawing) secured on the body 1 of the device and of a grip mechanism 7 connected by links 6 with the drive. The grips are controlled by hydraulic cylinders installed on a slide of the grip mechanism 7 and are designed to hold the ram 2 on its return stroke. While a specific embodiment of the return stroke unit of the ram 2 has been disclosed in the description, it will be understood that it does not confine the function or the scope of the invention so that the return stroke unit of the ram 2 may have any other practical design ensuring the return of the ram 2 to the rearmost position on its return stroke and its release before the beginning of the forward stroke.

There also is a unit for braking the ram on its idle stroke, constituted by a space 8 arranged in the body so that it opens on one side into the power cylinder, and by a cylindrical member 9 accommodated in the space 8 with a provision for reciprocating parallel with the movement of the ram 2.

One end of the cylindrical member 9 has a piston-like boss 10 whose outer cylindrical surface contacts the inner cylindrical surface of the space 8. The middle portion of the cylindrical member 9 is provided with another circular boss 11 separated from the piston-like boss 10 by a space and having its outer cylindrical surface contacting the inner cylindrical surface of the space 8. The other end 12 of the cylindrical member 9 protrudes from the space 8 into the power cylinder 5. The piston-like boss 10 and the other boss 11 separate the entire inner space 8 into two chambers 13 and 14. The first of these, referred to hereinafter as the reverse stroke chamber 13 is defined by the end wall of the space 8, its cylindrical surface and one end of the cylindrical member 9 with the piston-like boss 10. Like the power cylinder 5, this reverse stroke chamber 13 is filled through inlet tubing or pipe 33 with a fluid medium under pressure. The fluid pressure in the reverse stroke chamber 13 may be either equal to or slightly higher than the pressure in the power cylinder 5. The reverse stroke chamber 13 is intended to bring the braking unit to the initial position after the reverse idle stroke of the ram 8.

The other chamber, referred to hereinafter as the brake chamber 14 is defined by the space limited by the piston-like and other bosses 10 and 11, by the peripheral surface 15 of the cylindrical member 9 between these bosses and by the inner cylindrical surface of the space 8. Provided in the inner space of the brake chamber 14 on the cylindrical surface of the space 8 is a circular throttling projection 16 whose inner cylindrical surface forms, together with the peripheral surface 15 of the cylindrical member 9, a throttling gap. The brake chamber 14 is filled through inlet tubing or pipe 32 with fluid and is throttled in the process of braking of the ram 2 during its idle stroke whereby energy is transmitted from the ram 2 to throttling fluid and this energy is dissipated in the form of heat into the ambient space. During operation of the braking unit the fluid is not discharged from the brake chamber 14 so that its replenishment becomes necessary only for making up for leaks through the sealing elements.

The extension 4 of the ram 2 carries a boss 17 intended to interact with the end of the cylindrical member of the braking unit on the idle stroke of the ram 2.

This construction of the braking unit of the ram 2 eliminates completely the action of the ram 2 on the elements of said unit during the power stroke of the ram 2. This prolongs considerably the service life of the braking unit. The loads originated on the elements of said unit during its operation in the process of braking the ram at the end of its idle stroke can be reduced to permissible limits by selecting the appropriate parameters of this unit.

Figure 2:
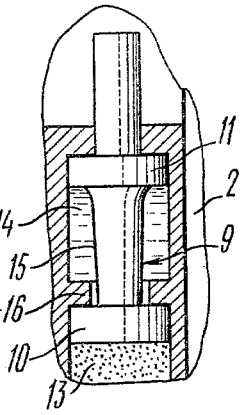
FIG. 2 shows the cylindrical member with a profiled surface according to FIG. 1, enlarged.

To achieve minimum loads on the elements of the unit in the course of braking the ram 2 at a preset braking stroke, the profile of the peripheral surface 15 (FIG. 2) of the cylindrical member 9 located between the piston-like boss 10 and the other boss 11 is made so as to ensure a constant pressure differential on the throttling gap throughout the entire braking path of the ram 2. The shape of the profiled portion of the surface 15 participating in the formation of the throttling gap can be defined by the inner cylindrical surface of the throttling projection 16 and by the surfaces of the variable-depth groove (not shown in the drawing) on the surface 15 of the cylindrical member 9.

The use of the profiled surface 15 of the cylindrical member 9 ensuring a constant throttling pressure reduces to a minimum the loads on the elements of the braking unit of the ram 2 thereby raising considerably their operational reliability and prolonging their service life.

In practice it often is convenient to realize the braking unit in the form of a space 18 (FIG. 3) similar in shape to the space 8 as shown in FIG. 1 but arranged axially in the body 1, and of a cylindrical member in the form of a sleeve 19 accommodated in said space 18 and fitting around the ram 2.

The impact device provided with such a braking unit may in some cases have smaller dimensions and mass than the device with another type of the braking unit.

Besides, coaxial arrangement of the braking unit of the ram 2 has a positive effect on the transmission of loads thereby improving the reliability of the device.

Figure 5:
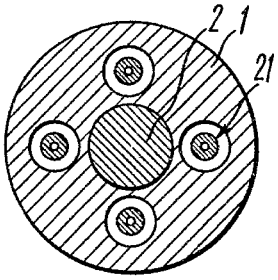
FIG. 5 is a cross section of the body of the device according to FIG. 4 in the region of brake chambers.
Figure 4:
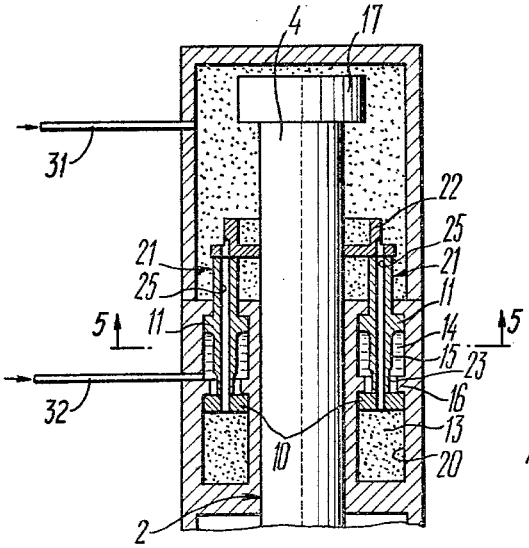
FIG. 4 illustrates another practical version of the braking unit in the impact device according to the invention.
Figure 7:
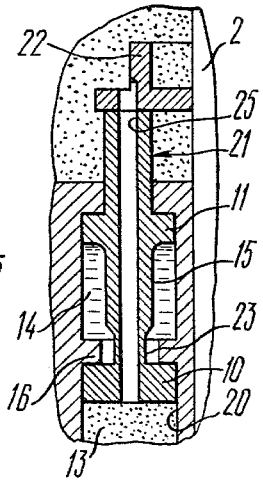
FIG. 7 shows the cylindrical member in the device according to FIG. 4, enlarged.

In another embodiment of the braking unit shown in FIG. 4 the body 1 has several spaces 20 similar to the space 8 shown in FIG. 1, equispaced around the circumference and parallel to the axis of the ram 2. All these spaces 20 accommodate cylindrical members 21 similar to the cylindrical member 9 shown in FIG. 1. The brake chambers 14 of all these spaces communicate with one another. The symmetrical arrangement of the spaces 20 and of cylindrical members 21 accommodated therein is illustrated in FIG. 5 which represents a cross section of the device in the zone of the brake chambers 14, for example with four spaces 20 and four cylindrical members 21.

The parallel arrangement of several spaces 20 and cylindrical members 21 therein reduces the mass of the moving parts of the braking unit and guarantees operation of the braking unit even in case of failure of some of the cylindrical members. This raises the reliability of the impact device according to the invention.

On the idle stroke of the ram 2 the interaction of the boss 17 (FIG. 1) with the face portion of the other end 12 of the cylindrical member 9 at the initial moment takes the form of a collision. At sufficiently high ram speeds such a collision produces considerable contact stresses in the colliding elements. To prevent this phenomenon, the cylindrical members in the practical realizations of the invention are provided with a cup-shaped element 22 (FIG. 4) arranged coaxially with the ram 2 and having a hole in the bottom for the passage of said ram 2. The diameter of the space of the cup-shaped element 22 in this case is essentially equal to the diameter of the boss 17 (FIGS. 3, 4) of the extension 4 of the ram 2.

The provision of the cup-shaped element 22 in the braking unit permits its moving elements to be accelerated to a speed approaching that of the ram 2 by compressing the fluid medium when the boss 17 of the extension 4 of the ram 2 enters the cup-shaped element 22.

This precludes direct collision of the boss 17 of the ram 2 with the cylindrical members 19 (FIG. 3) or 21 (FIG. 4) thus largely reducing the contact stresses in the interacting elements. This, in turn, increases their reliability and service life.

To ensure efficient functioning of the braking unit of the ram 2 it is necessary that the cylindrical members 19 (FIG. 3) and 21 (FIG. 4) should acquire the speed of the ram 2 on the shortest possible path. However, this is hindered by the fluid throttling pressure in the brake chamber 14. To reduce this pressure, the peripheral surface 15 of the cylindrical member 19 (FIG. 3) and 21 (FIG. 4) is provided between the piston-like boss 10 and the other boss 11 with a recess 23 (FIGS. 3, 4, 6, 7) adjoining the piston-like boss 10. The width of this recess is not smaller than that of the throttling projection 16.

The provision of said recess 23 reduces sharply the fluid throttling pressure at the moment of acceleration of the cylindrical member 9 (FIG. 3) and 21 (FIG. 4) which, in turn, reduces the acceleration path and time of said member and the force required for this acceleration. A reduction of the accelerating force causes a decrease in the fluid pressure in the cup-shaped element 22 when the latter interacts with the boss 17 of the extension 4 of the ram 2. And this diminishes the ultimate tensile stresses in the walls of the cup-shaped element 22, thereby extending its service life.

As has been stated above, the pressure of the fluid medium in the reverse stroke chamber 13 may be equal to the pressure of the fluid medium in the power cylinder 5. This permits putting the reverse stroke chamber 13 in communication with the power cylinder 5. It is expedient that the passage 24 (FIG. 3) communicating the reverse stroke chamber 13 with the power cylinder 5 in the device with one cylindrical member in the form of a sleeve 19 (FIG. 3) should be made in the body 1 so as not to weaken the walls of the sleeve 19 subjected to a considerable pressure of the throttled fluid. On the contrary, in the device with several cylindrical members 21 (FIG. 4) it is more expedient to make the passage 25 in the central part of the cylindrical members 21.

This layout actually does not reduce the strength of the cylindrical members 21 but simplifies substantially the manufacture of the braking unit and reduces somewhat the mass of its movable parts.

Communication of the reverse chamber 13 (FIGS. 3, 4) with the power cylinder 5 permits providing only one fluid feed to the device and ensures their simultaneous filling, thereby preventing the possibility of action of the ram 2 on the braking unit which is not prepared for operation; this improves the reliability of the device.

After the speeds of the ram 2 and cylindrical member 19 (FIG. 3) or 21 (FIG. 4) are equalized, there is no longer any need in the presence of the fluid medium in the cup-shaped element 22; moreover, the presence of fluid in this space becomes highly undesirable since the braking force of the ram 2 is substantially greater than the force required for accelerating the movable elements of the braking units to the speed of the ram 2.

To free the space of the cup-shaped element 22 of the fluid locked therein by the boss 17, the device is provided with throttling means.

Figures 8, 9, 10, 11:
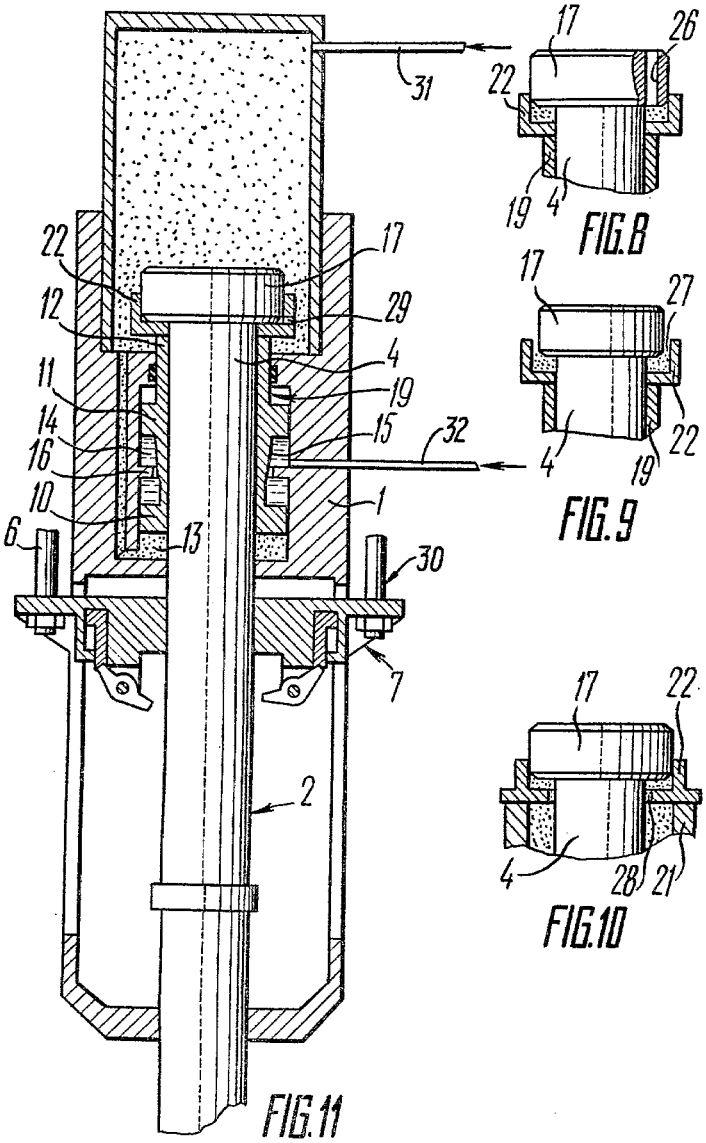
FIGS. 8, 9 and 10 illustrate practical versions of the fluid throttling means.
FIG. 11 shows the device according to FIG. 3 with the ram braking unit in the operating position.

Examples of such means are shown in FIGS. 8, 9, 10.

FIG. 8 shows said means in the form of a hole 26 in the boss 17 of the extension 4 of the ram 2. FIG. 9 shows another version of said throttling means in the form of a gap 27 between the outer cylindrical surface of the boss 17 of the extension 4 of the ram 2 and the inner cylindrical surface of the space of the cup-shaped element 22.

FIG. 10 shows the third version of said throttling means in the form of a gap 28 between the inner cylindrical surface of the hole in the bottom of the cup-shaped element 22 and the outer cylindrical surface of the extension 4 of the ram 2.

The above-cited embodiments of the actual realization of the throttling means do not by any means cover all the probable versions of its realization and do not confine the substance and the scope of the invention.

The provision of a means for throttling the fluid medium flowing out of the space of the cup-shaped element 2 ensures the discharge of the fluid medium from said space during braking of the ram 2. This extends the service life of the cup-shaped element thereby improving the reliability of the entire impact device.

Figure 3:
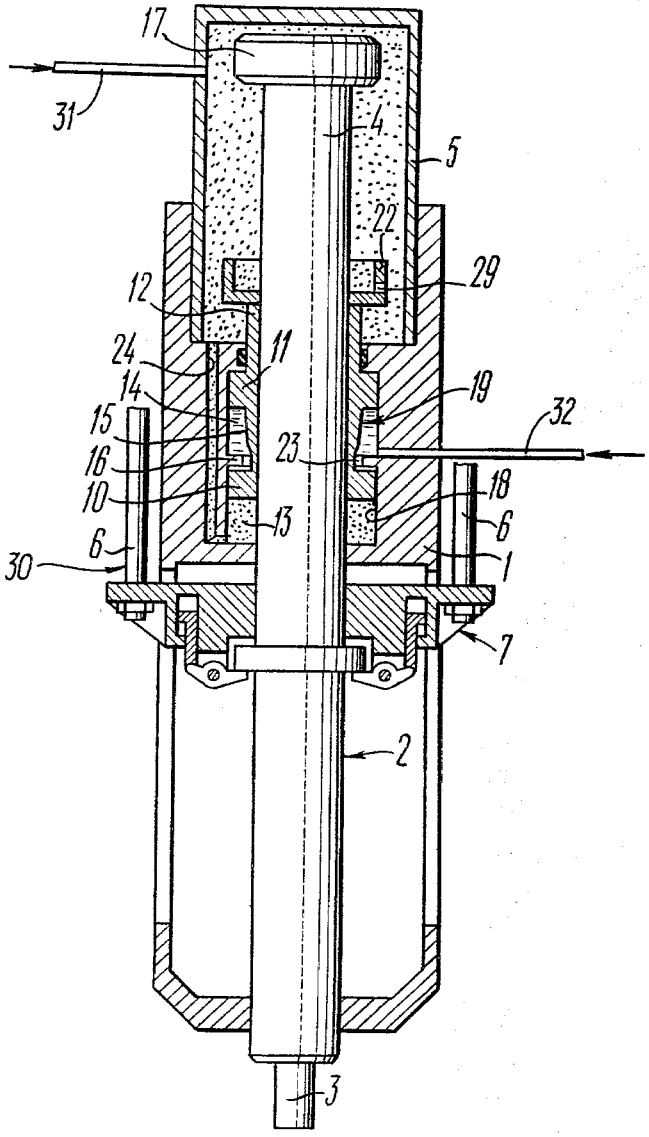
FIG. 3 illustrates one of the practical versions of the impact device.

Now let us consider the functioning of the impact device according to the invention by describing one of the practical embodiments, for example that shown in FIG. 3 and FIG. 11.

In FIG. 3 the device is shown in the position when the ram 2 is at the end of the reverse stroke.

At this moment the levers of the gripping mechanism 7 turn and cease to interact with the ram 2. Being released by the gripping mechanism and being acted upon by the pressure of the fluid medium applied to the end of its extension 4, the ram 2 is accelerated and moves forward to the object of work. This motion is the forward stroke of the ram 2. If at the end of the forward stroke the ram interacts with the object of work by its front part 3 and applies all the accumulated energy in the form of an impact pulse, to said object of work the ram stops. This process will be referred to hereinafter as the working or power stroke of the ram.

At the same time the gripping mechanism 7 is moved by a drive (not shown in FIG. 1) after the ram 2. As soon as the gripping mechanism 7 starts interacting with the ram 2, its levers close and the drive is shifted over to the reverse motion.

This marks the beginning of the cocking stroke of the ram. At the end of the cocking stroke the above-described cycle is repeated over again.

Meanwhile, the braking unit takes no part in the functioning of the device.

If, however, the ram 2 at the end of its forward stroke does not encounter the object of work or due to some circumstances does not spend the entire amount of energy accumulated during acceleration for producing an impact pulse acting on the object of work, the braking unit steps in. Such a stroke of the ram 2 will be called an idle stroke.

On the idle stroke of the ram 2 the braking unit functions as follows. At the end of the forward stroke of the ram 2 the boss 17 enters the space of the cup-shaped element 22, locks it and, moving farther on, starts compressing the fluid medium in said space. This relative position of the boss 17 and cup-shaped element 22 is illustrated in FIGS. 8, 9, 10. The fluid medium acting on the bottom of the cup-shaped element 22 under a considerable pressure (usually up to a few tens of MPa), accelerates the movable elements of the braking unit to the speed of the ram 2. Simultaneously, the fluid medium leaks out through the throttling means shown in this embodiment in the form of a hole 29 (FIG. 3) so that the face surfaces of the boss 17 and of the bottom of the cup-shaped element 22 converge until they come in contact with each other.

At the same time the bosses 10 and 11 of the cylindrical member 19 move jointly with said member. The volume of the space between the other boss 11 and the throttling projection 16 in the braking chamber 14 diminishes whereas the volume of the space between the throttling projection 16 and the piston-like boss 10 grows by the same value, the volume of the braking chamber 14 staying unchanged. Therefore, the fluid is forced from one of said spaces into the other through the gap formed by the cylindrical surface of the throttling projection 16 and by the cylindrical surface of the recess 23. However, inasmuch as the passage area of said gap is sufficiently large, the fluid flows without any considerable resistance and does not interfere with the acceleration of the movable elements of the braking unit. By the moment the speeds of the ram 2 and of the movable elements of the braking unit become equalized, the space of the cup-shaped element 22 is already free of the fluid medium and the profiled surface 15 of the cylindrical member 19 comes under the cylindrical surface of the throttling projection 16. This phase of operation of the device is illustrated in FIG. 11. From this moment on, firstly the ram 2 and the movable elements of the braking unit move as an integral body and, secondly, the area of the gap between the cylindrical surface of the throttling projection 16 and the profiled surface 15 of the cylindrical member 19 is sharply reduced.

This leads to a sharp rise of the fluid throttling resistance in said gap, and, consequently, to a rise of the fluid pressure in the space between the other boss 11 of the cylindrical member 19 and the throttling projection 16 in the braking chamber 14. This fluid pressure acting on the end surface of the other boss 11 produces a braking force thereon and, with a proper selection of the profile of the surface 15, the movable system consisting of the ram 2 and the cylindrical member 19 is braked with a constant force over the entire preset braking path which means that under these conditions the braking path does not virtually depend on the energy accumulated by the ram 2 and the pressure in said space is directly proportional to said energy. Thus, the ram 2 is braked practically on the length of the path which is equal to the distance between the other boss 11 of the cylindrical member 19 and the throttling projection 16 of the body 1 in the initial position of the cylindrical member.

After the movable system has come to a stop, the gripping mechanism 7 moving after the ram 2 as during the working stroke grips the ram 2 and sends it on a cocking stroke by the drive. In the course of the cocking stroke of the ram 2 the cylindrical member 19 moves after said ram. This motion is originated by the pressure of the fluid medium applied to the extra area of the end of the piston-like boss 10 from the side of the reverse stroke chamber 13 because the area of the end face of the piston-like boss 10 of the cylindrical member 19 is larger than the area of the end face of the other end 12 of the cylindrical member 19 located in the power cylinder 5 whereas the pressure of the fluid medium in the reverse chamber 13 is the same as that in the power cylinder 5 because they are in communication with each other through the passage 24. In view of the fact that the speed of the cylindrical member 19 being actually equal to that of the ram 2 and set by the drive of the ram reverse stroke unit is substantially lower that the braking speed of the ram 2, the resistance to the fluid flow from the space between the piston-like boss 10 of the cylindrical member 19 and the throttling projection 16 into the space between the other boss 11 of the cylindrical member 19 and the throttling projection 16 through the gap between the cylindrical surface of the latter and the profiled surface 15 of the cylindrical member 19 is quite low and does not interfere with the movement of the cylindrical member 19.

Thus, the cylindrical member 19 continues moving until it returns to the initial position. Then it stops and the boss 17 of the extension 4 of the ram 2 starts coming out of the space of the cup-shaped element 22. Here again, due to a low speed of the cocking stroke of the ram 2 the fluid medium flows freely into the space of the cup-shaped element 22 through the throttling means 29 so that there is nothing to prevent the boss 17 from leaving the space of the cup-shaped element 22. As soon as the boss 17 has come out of the cup-shaped element 22, the braking unit is again ready for operation.

The braking unit illustrated in FIG. 4 functions in a similar manner. The only difference from the above-described process lies in that the unit according to FIG. 4 is capable of operating even when there is no fluid in some of its braking chamber 14. In this case the pressure in the fluid-filled chambers of the operating unit will rise correspondingly.

What is claimed is:

1. An impact device for producing impact pulses acting on the object of work comprising a body; a ram having a front portion effecting on the object of work by impact pulses at the end of its forward motion and a tail portion with at least one boss near its cross-cut and installed in said body with a provision for reciprocating movement; a power cylinder connected with said body so that it accommodates said tail portion of ram and is filled with a compressible fluid medium under pressure intended to accumulate potential energy in said power cylinder when being compressed during the backward motion of the ram and to act on the cross-cut end of said tail portion of said ram on its forward motion; a backward motion unit of the ram mounted on said body and being capable of interacting with said ram for performing the backward motion of the ram and compressing said compressible fluid medium; a unit for braking said ram at the end of its idle motion comprising at least one space located in said body so that it opens at one side into said power cylinder and a cylindrical member one end of which is provided with a circular piston-like boss and the middle part is provided with another circular boss separated from said piston-like boss by an annular space, said cylindrical member being accommodated in said body space with a provision for reciprocating movement so that the other end of said cylindrical member protrudes from the body into the space of said power cylinder and is intended to interact with said boss of the tail portion of the ram while said piston-like and other bosses are located inside of said space of the body, contacting with its surface, wherein said one space comprises at least two chambers, with a first chamber formed by the end face of said piston-like boss and the surface of said space of the body near said one end of the cylindrical member, filled with a compressible fluid medium under pressure for performing the backward motion of the cylindrical member; and a second chamber comprising a braking chamber formed by the surface of said cylindrical member between said piston-like and other bosses and the surface of said space of the body and filled with a fluid; and a circular throttling projection in the body, inside of said body space, located between said piston-like and other bosses of the cylindrical member and forming with the surface of the cylindrical member a gap intended to throttle the fluid in the process of braking said ram on its idle motion.

2. A device according to claim 1 wherein the peripheral surface of said cylindrical member between said piston-like and other bosses is made so that the fluid is throttled with a constant differential of its pressure.

3. A device according to claim 1 wherein said other end of the cylindrical member is provided with a cup-shaped element arranged coaxially with said ram and having a hole in its bottom for the passage of the ram, the diameter of the space of the cup-shaped element being substantially equal to the diameter of the boss of said ram tail portion.

4. A device according to claim 2 wherein said braking unit is formed by one space made in said body coaxially therewith and having in its face wall a hole for the passage of said ram, and by one cylindrical member made in the form of a sleeve embracing said ram with a provision for moving relative thereto.

5. A device according to claim 2 wherein said braking unit is formed by several spaces equispaced in said body around its circumference parallel to the ram axis, and by a corresonding number of cylindrical members housed in said spaces.

6. A device according to claim 1 wherein said other end of the cylindrical member is provided with a cup-shaped element arranged coaxially with said ram and having a hole in its bottom for passage of the ram, the diameter of the space of the cup-shaped element being substantially equal to the diameter of the boss of said ram tail portion.

7. A device according to claim 6 wherein the peripheral surface of said cylindrical member between its piston-like and other bosses is provided with a recess adjoining said piston-like boss, the width of said recess being not smaller than the width of said throttling projection of the body so that when said throttling projection is positioned opposite said recess, the passage area of the gap between said recess and projection reduces the resistance of the throttled fluid at the initial moment of movement of the cylindrical member.

8. A device according to claim 6 further comprising means for throttling the compressible fluid medium on interaction of the boss of said ram tail portion with the cup-shaped element.

9. A device according to claim 1 wherein the braking unit is formed by one space made in the body coaxially therewith, the face wall of said space having a hole for the passage of said ran and by one cylindrical member in the form of a sleeve embracing said ram with a provision for moving relative thereto.

10. A device according to claim 1 wherein the braking unit is formed by several spaces equispaced in the body around its circumference and parallel to the axis of said ram, and by a corresponding number of cylindrical members housed in said spaces.

11. A device according to claim 10 wherein each reverse stroke chamber of the cylindrical member communicates with said power cylinder through a passage made in said cylindrical member.

12. A device according to claim 1 wherein said backward motion chamber of the cylindrical member is in constant communication with said power cylinder.

13. A device according to claim 12 wherein each backward motion chamber of the cylindrical member communicates with said power cylinder through a passage made in said body.

14. An impact device comprising a braking unit, and a ram reciprocatably disposed in a power cylinder connected to a body, the ram having a forward power stroke, a reverse stroke, and an idle stroke prior to the start of the reverse stroke when some of the energy urging the ram forward during the power stroke remains at the end of the forward power stroke, said braking unit comprising:

(a) a space formed in said body defining a braking cylinder opening into the power cylinder containing the ram; and (b) a cylindrical member disposed in said braking cylinder, said cylindrical member having:

(1) a piston-like boss formed at one end thereof inserted into said braking cylinder so as to define a reverse stroke chamber between the boss and walls of said body defining the braking cylinder;

(2) a circular boss positioned intermediate ends of the cylindrical member and cooperating with walls of said body defining the braking cylinder and said piston-like boss to define a braking chamber; portions of the walls defining the braking chamber including means for defining a throttling passage intermediate said bosses for throttling fluid flow during movement of said cylindrical member to brake movement of said ram during its idle stroke, and (c) an end portion on said cylindrical member being movable into an initial braking position in which said end portion projects into said power cylinder to contact means on said ram to oppose movement of said ram at the end of the power stroke thereof to thereby begin the idle stroke, said braking chamber being filled with fluid to oppose movement of the cylindrical member by the ram during the idle stroke of the ram, said reverse stroke chamber being filled with fluid to urge said cylindrical member towards its initial braking position.

* * * * *

UNITED STATES PATENT AND TRADEMARK OFFICE

CERTIFICATE OF CORRECTION

PATENT NO. : 4,343,368

DATED : Aug. 10, 1982

INVENTOR(S) : Vladimir Y. FADEEV

It is certified that error appears in the above—identified patent and that said Letters Patent is hereby corrected as shown below:

On the title page, before line "[51]", insert:

[30] Foreign Application Priority Data

Dec. 27, 1978 [SU] U.S.S.R. ..... 2697151

Signed and Sealed this

*Twenty-third* Day of *November 1982*

[SEAL]

*Attest:*

GERALD J. MOSSINGHOFF

*Attesting Officer*

*Commissioner of Patents and Trademarks*